United States Patent [19]

Hennessy

[11] Patent Number: 4,484,463

[45] Date of Patent: Nov. 27, 1984

[54] DOOR LOCK GUARD

[75] Inventor: Thomas F. Hennessy, Bristol, Conn.

[73] Assignee: Lori Corporation, Southington, Conn.

[21] Appl. No.: 423,827

[22] Filed: Sep. 27, 1982

[51] Int. Cl.[3] ..... E05B 15/02

[52] U.S. Cl. ..... 70/452; 70/417; 292/346

[58] Field of Search ..... 70/452, 417; 292/346; 49/504

[56] References Cited

U.S. PATENT DOCUMENTS 3,698,217 10/1972 Roy ..... 70/452

4,074,552 2/1978 Smith ..... 70/417

*Primary Examiner*—Robert L. Wolfe

[57] ABSTRACT

A guard for protecting the cylinder of a door lock from removal comprises a substantially rectangular plate having a first portion including a section adapted to fit over the lock cylinder and a second portion offset from the first portion, the second portion traversing the gap between the door and the doorjamb for protecting the bolt.

4 Claims, 3 Drawing Figures

DOOR LOCK GUARD

BACKGROUND OF THE INVENTION

The present invention is directed to a door lock guard for prohibiting forced entry and, more particularly, a door guard for protecting the cylinder of a door lock.

In recent years there has been a significant increase in the number of burglaries and forced entries being perpetrated. There are a number of sophisticated burglar alarm systems available which detect unlawful entry and sound a warning. While these known systems are quite reliable and effective they generally are fairly expensive to purchase and install thus making them beyond the financial reach of the majority of individuals. Naturally, it would be highly desirable to provide a device for prohibiting forced entry which is inexpensive to manufacture and simple to install.

Devices which protect the latch bolt of door locks from forcible retraction are known in the art. These devices are comparatively inexpensive and comprise a member which shields the latch bolt whereby it cannot be engaged by a "tool" inserted between the door and doorjamb. Such prior mechanical safety devices, however, do not prevent unauthorized access obtained by forced rotation of the lock cylinder. The lock cylinder is typically threaded into the lock and subsequently restrained against rotation by a single set screw which is inserted in the lock face plate from the door end. In most installations a sufficient portion of the cylinder extends from the surface of the door to permit the gripping thereof with a jaw-type tool. Twisting of the cylinder will result in bending the set screw whereupon the cylinder may be unscrewed sufficiently to open the lock. Decorative plates which are sometimes placed about the protruding cylinder are easily crushed and thus do not alleviate the problem.

Accordingly, it is the principal object of the present invention to provide a door guard for prohibiting forced entry.

It is a particular object of the present invention to provide a door guard for protecting the cylinder of a door lock from forced entry.

It is a further object of the present invention to provide a door guard for prohibiting forced entry which is inexpensive to manufacture and easy to install.

Further objects and advantages of the present invention will appear below.

SUMMARY OF THE INVENTION

In accordance with the present invention, the foregoing objects and advantages are readily obtained.

In conventional door and doorjamb arrangements employing door locks of the latch bolt type, it is relatively easy to engage the lock cylinder whereupon, by the application of sufficient rotational force, the cylinder may be unscrewed thereby opening the door. The present invention relates to a door guard for protecting the cylinder of a door lock. While not limited in its utility, the present invention is particularly well-suited for use on swinging, metal framed, glass doors of the type used in many commercial establishments. In accordance with the present invention, the door guard comprises a substantially rectangular plate having an apertured first portion adapted to fit over and protect the cylinder of a lock installed in a door and a second portion offset from the first portion for traversing the gap between the door and the doorjamb. The substantially rectangular plate is secured to the door by suitable fastening means and protects both the cylinder and the latch bolt of the door lock from tampering. The present invention comprises an inexpensive device which is of simple construction, is easily installed and which protects the cylinder and latch bolt of a door lock from forced movement.

BRIEF DESCRIPTION OF THE DRAWINGS

The present invention may be better understood and its numerous objects and advantages will become apparent to those skilled in the art by reference to the accompanying drawing wherein like reference numerals refer to like elements in the several FIGURES and in which.

DETAILED DESCRIPTION

Figure 1:
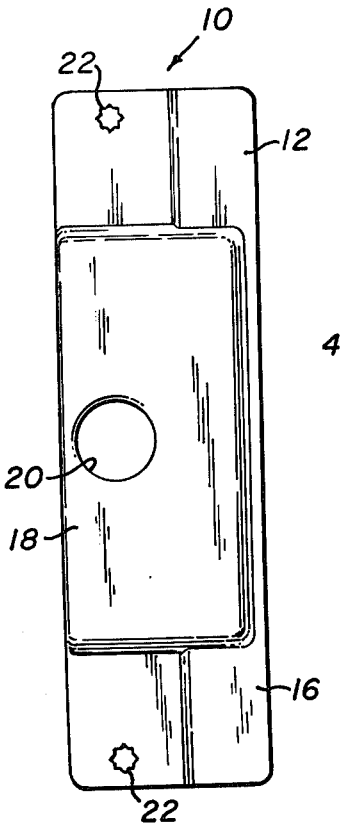
FIG. 1 is a top view of a preferred embodiment of the present invention.
Figure 2:
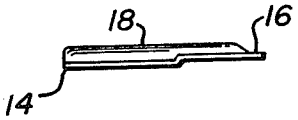
FIG. 2 is a side view of the guard of FIG. 1.
Figure 3:
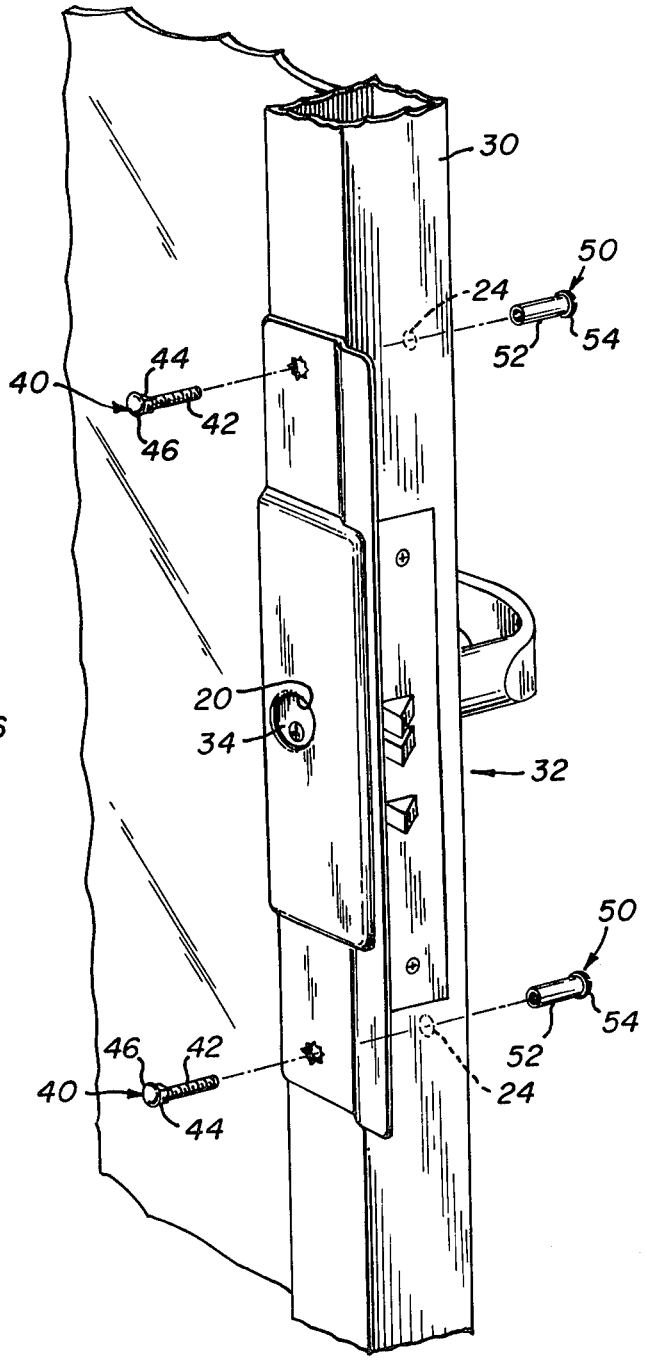
FIG. 3 is an exploded perspective view of the guard of FIGS. 1 and 2 illustrating installation thereof on a door.

Referring to the drawing, the guard of the present invention comprises a substantially rectangular plate 12 having a first portion 14 adapted to be secured to a door and a second portion 16 offset from the plane of said first portion 14 for traversing the gap between the door and the doorjamb. Portion 16, when viewed from the side which will face the door, is provided with an apertured recess 18. When the guard of the present invention is installed, the cylinder of the lock, indicated at 34 in FIG. 3, is aligned with the aperture 20 provided in recess 18 of plate portion 14. First portion 14 is further provided with a pair of opposed polygonal shaped holes 22 on either side of aperture 20 for securing the plate 12 to a door.

With particular reference to FIG. 3, the installation of the door guard 10 of the present invention will be discussed in detail. Plate 12 is positioned over the lock 32 of a door 30 such that the exposed portion of lock cylinder 34 is aligned with aperture 20 and is flush with or positioned slightly inwardly of the outer surface of recessed portion 18 of plate portion 14. A pair of bore holes 24 are provided in the door for securing the door guard in place. The fasteners for securing door guard 10 to the door 30 comprises a bolt 40 having a threaded shaft portion 42 and a polygonal shaped portion 44 which is to be of the same shape as polygonal holes 22 in plate 12. The bolt 40 has a round dead-head or bung-head portion 46 as illustrated in FIG. 3. A female sleeve nut 50 having a sleeve portion 52 and a screw-head portion 54 receives the bolt 40 for securing the door guard 10 in place in the following manner. The bolts 40 are located in polygonal shaped holes 22 in plate 12 and bore holes 24 in door 30 such that the sides of polygonal holes 22 abut with the sides of polygonal-shaped portion 44 of bolts 40 so as to prohibit rotation of the bolts. The female sleeve nuts 50 receive threaded shaft portions 42 of the bolts 40 in sleeve portions 52 and are screwed down thereon by means of slotted screw-head portions 54 until tightened. By virtue of the mating polygonal surfaces of holes 22 and portion 44 of bolt 40 in combination with the dead-head or bung-head portion 46 of bolt 40, removal of the fastening means from outside the door is prohibited.

By way of the present invention, an inexpensive device which is of simple construction and easily installed protects the latch bolt of a door lock from forced entry. With the door guard in place and the door in the closed position, the offset portion 16 of the plate 12 traverses the gap between the door and doorjamb thereby shielding and thus protecting the latch bolt from tampering. The present invention also protects the peripheral portions of the lock cylinder. The shape of the recessed portion 18 of plate 12, coupled with the nature and guage of the material from which the plate is formed, insures that the cylinder 34 cannot be engaged by a tool and subsequently rotated, i.e., the plate cannot be bent to gain access to the periphery of the lock cylinder.

It is to be understood that the invention is not limited to the illustration described and shown herein, which are deemed to be merely illustrative of the best mode of carrying out the invention, and which is susceptible of modification of form, size, arrangement of parts and details of operation. The invention rather is intended to encompass all such modifications which are within its spirit and scope as defined by the claims.

What is claimed is:

1. A door guard for protecting a door from forced entry, the door being provided with a lock having a cylinder and a reciprocal bolt operatively coupled to a rotatable plug housed within the cylinder, the cylinder protruding from a first flat side surface of the door and the bolt normally extending from an end of the door, said guard comprising:

a first generally rectangular shaped housing member, said housing member having a planar base portion and four side walls extending outwardly therefrom, said base portion and side walls defining a recess, said base portion being provided with an aperture;

a pair of flat sided coplanar generally rectangular shaped mounting members, said mounting members being integral with and extending in opposite directions from the ends of first and second oppositely disposed of said side walls of said housing member, said mounting members being oriented parallelly with respect to the plane of said housing member base portion and being each provided with a mounting hole whereby said guard may be affixed to the said first side surface of a door with the first side of each of said mounting members abutting said door first side surface and the door lock cylinder located within said recess in registration with said aperture;

a bolt guard, said bolt guard being integral with said housing member and said mounting members, said bolt guard having a first portion which defines a plane parallel to the planes of said housing member base portion and said mounting members, the plane defined by said bolt guard first portion being disposed intermediate the planes of said housing member base portion and mounting members, said bolt guard being coextensive in length with said housing member and mounting members, said bolt guard further having a pair of side walls which extend between said first portion thereof and said mounting members, at least a third of said housing member side walls terminating at said bolt guard first portion in a region disposed between said bolt guard side walls, said bolt guard extending outwardly from an edge of the door to shield the bolt when in its normally extended condition; and means for mounting said door guard to the door, said mounting means extending through said mounting holes in said mounting members and passing through the door.

2. The door guard of claim 1 wherein said bolt guard is generally C-shaped and said first and second side walls of said housing member in part terminate at said bolt guard first portion.

3. The door guard of claim 2 wherein said mounting holes in said mounting members have an irregular shape and wherein said mounting means are each provided with a portion having a shape complimentary to the shape of said mounting holes.

4. The door guard of claim 3 wherein said mounting means each comprise:

an elongated member having a smooth rounded head, a threaded shaft portion, and an irregularly shaped shoulder portion which connects said head portion to said shaft, said shoulder portion having a shape complimentary to the shape of said mounting holes; and an internally threaded tubular member which engages said threaded shaft portion, said tubular member having a head which may be engaged by a tool, said head being positioned at least in part to the exterior of a second flat side surface of the door which is disposed oppositely from and parallel to the door first flat side surface.

* * * * *